US009420868B2

(12) United States Patent
Crapet et al.

(10) Patent No.: US 9,420,868 B2
(45) Date of Patent: Aug. 23, 2016

(54) CASING FOR A COSMETIC ARTICLE

(75) Inventors: Yann Crapet, Pontoise (FR); Patrick Fraillon, Mamaroneck, NY (US)

(73) Assignee: Albea Services, Gennevilliers (FR)

( * ) Notice: Subject to any disclaimer, the term of this patent is extended or adjusted under 35 U.S.C. 154(b) by 0 days.

(21) Appl. No.: 13/568,360

(22) Filed: Aug. 7, 2012

(65) Prior Publication Data

US 2013/0048009 A1 Feb. 28, 2013

Related U.S. Application Data

(60) Provisional application No. 61/526,013, filed on Aug. 22, 2011.

(51) Int. Cl.
*A45D 33/20* (2006.01)
*A45D 33/00* (2006.01)

(52) U.S. Cl.
CPC ..... *A45D 33/20* (2013.01); *A45D 33/003* (2013.01); *A45D 33/008* (2013.01); *A45D 2200/052* (2013.01)

(58) Field of Classification Search
CPC ..... A45D 33/22; A45D 33/16; A45D 33/006; A45D 33/008; A45D 33/20; A45D 33/26; A45D 40/0087; A45D 40/24; A45C 11/008
USPC ..... 132/320, 287, 293, 294, 297, 301, 303, 132/304; D28/83; 206/581, 823
See application file for complete search history.

(56) References Cited

U.S. PATENT DOCUMENTS 1,485,357 A * 3/1924 Aber ..... A45D 33/26 132/295
1,601,991 A * 10/1926 Albert ..... 132/287
4,388,935 A * 6/1983 Napolitane ..... 132/294
4,898,195 A * 2/1990 Sussman ..... 132/317
5,054,505 A * 10/1991 Yuhara ..... 132/294
5,163,457 A * 11/1992 Lombardi, Jr. ..... A45D 42/02 132/294
5,431,177 A * 7/1995 Kecman ..... 132/303
6,889,696 B2 * 5/2005 Thorpe et al. ..... 132/287
6,932,220 B2 * 8/2005 Byun ..... A45D 33/006 132/287
7,975,705 B2 * 7/2011 Chen ..... 132/287
7,975,706 B2 * 7/2011 Chen ..... 132/287
8,286,646 B2 * 10/2012 Son et al. ..... 132/287
2008/0142031 A1 * 6/2008 Francis ..... 132/200
2010/0224212 A1 * 9/2010 Chen ..... A45D 40/24 132/287

FOREIGN PATENT DOCUMENTS

KR 10-0797769 * 1/2008

* cited by examiner

*Primary Examiner* — Rachel Steitz
*Assistant Examiner* — Jennifer Gill
(74) *Attorney, Agent, or Firm* — Banner & Witcoff

(57) ABSTRACT

A casing for a cosmetic article comprising a housing defining a window, a tray accommodated within the housing and being movable relative to the window of the housing, the tray accommodating the cosmetic article, and a zone defined within the housing and being movable relative to the window of the housing in response to the movement of the tray. The tray and the zone are movable relative to the housing between a retracted position, in which the cosmetic article is displayed through the window so that the cosmetic article can be visually inspected through the window, and an extended position, in which the tray protrudes from the housing to facilitate access to the cosmetic article and the zone can be viewed through the window. In an embodiment, the cosmetic product can be visually inspected through the window when the tray and the zone are in the retracted position.

12 Claims, 4 Drawing Sheets

CASING FOR A COSMETIC ARTICLE

FIELD OF THE INVENTION

The invention relates to a casing for a cosmetic article, such as a cosmetic powder pan containing a cosmetic powder, and an associated cosmetic applicator, and in particular to a window for, in a first configuration, enabling a user to view the cosmetic powder within the cosmetic powder pan, and, in a second configuration, presenting a mirror through the window to assist the user when applying the cosmetic powder contained in the cosmetic powder pan.

BACKGROUND OF THE INVENTION

Casings containing cosmetic articles are known, and typically comprise a base having one or more recesses for accommodating cosmetic articles, such as cosmetic powder pans and associated cosmetic applicators, and a cover which is hinged to the base for closing or opening the casing.

In some casings, a mirror may be fixed to an inner surface of the cover, so that when the user opens the casing, he or she can simultaneously access the cosmetic article and reveal the mirror in a single gesture, the mirror facilitating the application of the relevant cosmetic product. However, with such an arrangement, it is generally not possible for a user to be able to visually inspect the cosmetic articles within the casing prior to purchasing the casing.

In other casings, the cover comprises a window through which the cosmetic article can be viewed when the cover is in the closed position. Such a window allows the appearance of the cosmetic article housed within the casing to be displayed, without the need to open the casing. Such a presentation is particularly advantageous when the casings are displayed in retail stores. As the cosmetic articles are visible through the cover, it is not necessary to provide separate descriptions of the articles, such as photographs, colour charts, or separate testing samples. However, due to the presence of a window in the cover, it is generally not possible to include a "full size" mirror in the cover i.e. a mirror having the same dimensions as those of the cover.

OBJECT OF THE INVENTION

An aim of the invention is therefore to provide a casing for a cosmetic article that has a window for not only allowing a visual inspection of the cosmetic product within the casing, in a first configuration, but which can also be used by a user to inspect a mirror displayed through the window, in a second configuration.

SUMMARY OF THE INVENTION

According to the invention there is provided a casing for a cosmetic article, the casing comprising:

- a housing defining a window;
- a tray accommodated within the housing and being movable relative to the window of the housing, the tray accommodating the cosmetic article; and
- a zone defined within the housing and being movable relative to the window of the housing in response to the movement of the tray;

the tray and the zone being movable relative to the housing between a retracted position, in which the cosmetic article is displayed through the window so that the cosmetic article can be visually inspected through the window, and an extended position, in which the tray protrudes from the housing to facilitate access to the cosmetic article and the zone can be viewed through the window.

In an embodiment, the cosmetic article comprises a cosmetic product holder to hold the cosmetic product and an associated cosmetic applicator to facilitate the application of the cosmetic product contained in the cosmetic product holder.

In an embodiment, the cosmetic product can be visually inspected through the window when the tray and the zone are in the retracted position.

In an embodiment, the zone comprises or is fitted with a mirror so that in the extended position the mirror is displayed through the window, to facilitate the application of the cosmetic product.

In an embodiment, the casing comprises a clipping arrangement to secure the tray in place within the housing when the tray and the zone are in the retracted position, the clipping arrangement having an area that defines the zone.

In an embodiment, the clipping arrangement comprises at least one protruding lug that engages a complementary recess defined in the tray to so as to define the retracted position.

In an embodiment, the clipping arrangement can be actuated to release the protruding lug from the recess so as to enable the tray to be moved out of the housing.

In an embodiment, the casing comprises pushing means against which the tray is biased when the tray and the zone are in the retracted position, the pushing means being arranged to push the tray out of the housing after the clipping arrangement has been actuated to release the protruding lug from the recess.

In an embodiment, the pushing means comprises a spring arrangement positioned between an end wall of the housing and the tray.

In an embodiment, an intermediate position is defined, in which a portion of the tray protrudes from the housing but with the zone not being viewable through the window.

In an embodiment, in the movement between the retracted position and the intermediate position the tray moves relative to both the housing and the clipping arrangement.

In an embodiment, the end wall of the tray can abut against the at least one protruding lug extending from the clipping arrangement, so that in the movement between the intermediate position and the extended position the end wall of the tray abuts against the at least one protruding lug of the clipping arrangement so that both the tray and the clipping arrangement moves relative to the housing.

In an embodiment, the housing defines at least one internal guide channel to receive a guide pin extending from the clipping arrangement to facilitate the movement of the clipping arrangement relative to the housing.

DESCRIPTION OF PREFERRED EMBODIMENTS

Figure 1:
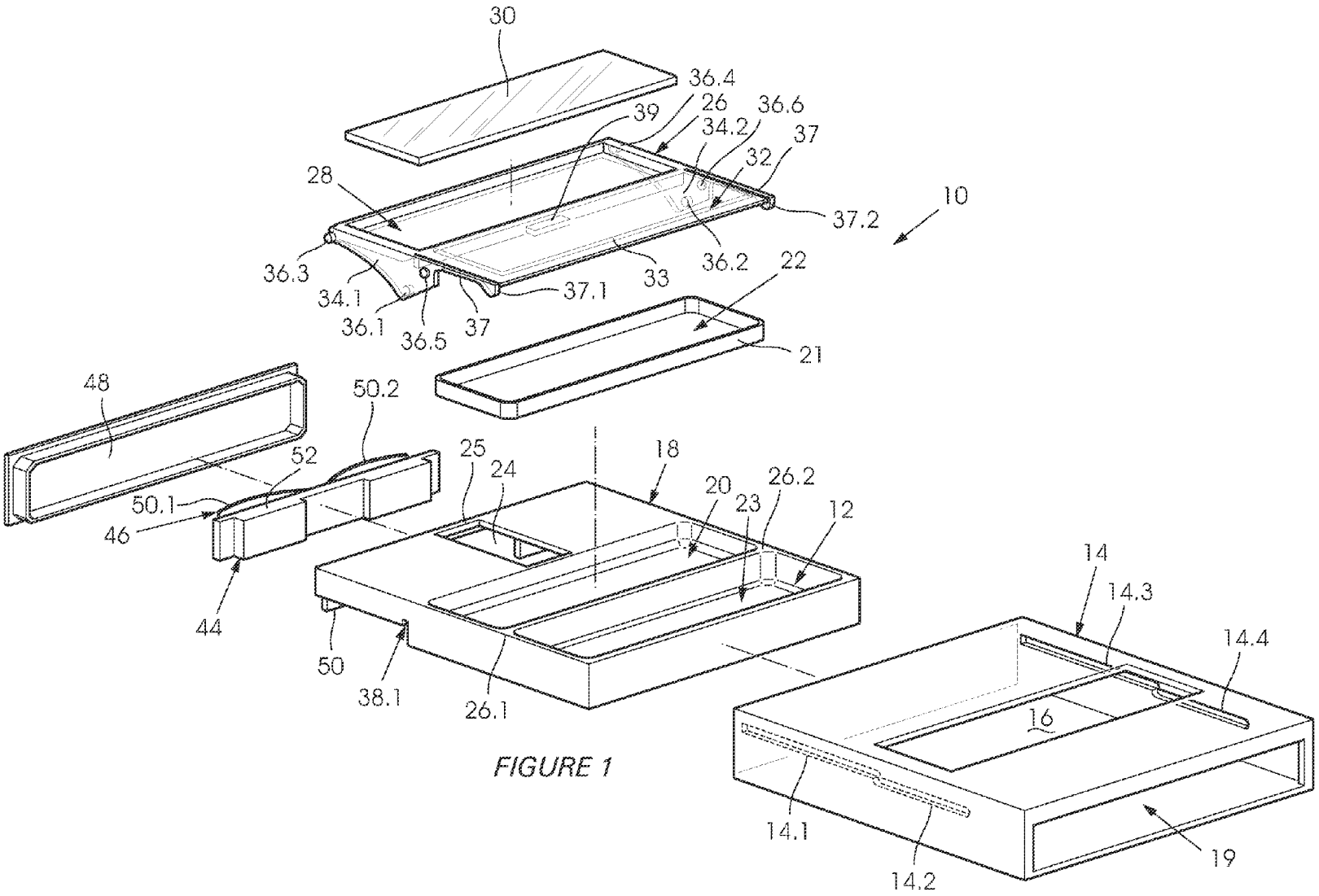
FIG. 1 shows an exploded perspective view of a casing for a cosmetic article according to an embodiment of the present invention, the casing comprising a housing, a tray and a clipping arrangement.

Referring to the drawings, a casing 10 for a cosmetic article 12 is shown. The casing 10 comprises a housing 14 that defines an inspection window 16 in an upper wall of the housing 14. A tray 18 is accommodated within the housing 14, the tray being slidably movable relative to the window 16 of the housing 14 through an opening 19 defined in a front wall of the housing 14. The window 16 is distinct from the opening 19, in that the window 16 does not accommodate movement of the tray; in other words, the tray 18 does not pass through the window 16. As is clear from FIG. 1, the upper wall of the housing 14 that defines the window 16 is perpendicular to a front wall of the housing 14 that defines the opening 19.

The tray 18 accommodates the cosmetic article 12, the tray 18 typically comprising a first recess 20 to receive a cosmetic product holder or pan 21 to hold a cosmetic product 22, such as a cosmetic powder. The tray 18 typically further comprises a second recess 23 to hold a suitable cosmetic applicator or brush (not shown) to facilitate the application of the cosmetic product contained in the cosmetic product holder 22. An elongate slot 24 is defined towards the rear of the tray 18, proximate an end wall portion 25, the purpose of which will be described in more detail further on in the specification.

In an embodiment, the casing 10 comprises a clipping arrangement 26 that is also slidably accommodated within the housing 14. The clipping arrangement 26 has an area that defines a zone 28 that, in an embodiment, comprises or is fitted with a mirror 30. The zone 28 is thus defined to be within the housing 14, with the clipping arrangement 26 (and thus the zone 28 and mirror 30) being slidably movable relative to the window 16 of the housing 14 in response to the movement of the tray 18, as will be described in more detail further below.

Figure 2:
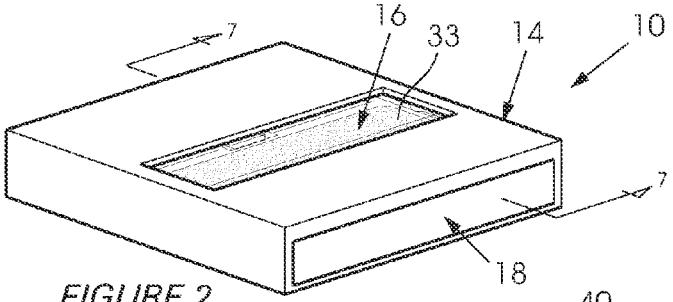
FIG. 2 shows a perspective view of the casing of FIG. 1 in an assembled, retracted position, in which the tray is fully accommodated within the housing.
Figure 6:
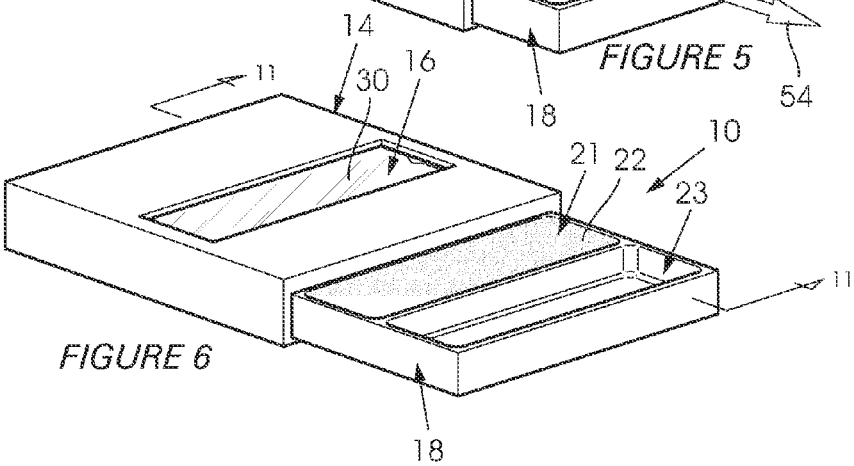
FIG. 6 shows a perspective view of the casing of FIG. 1 in an extended position, ready for use.
Figures 7, 8, 9:
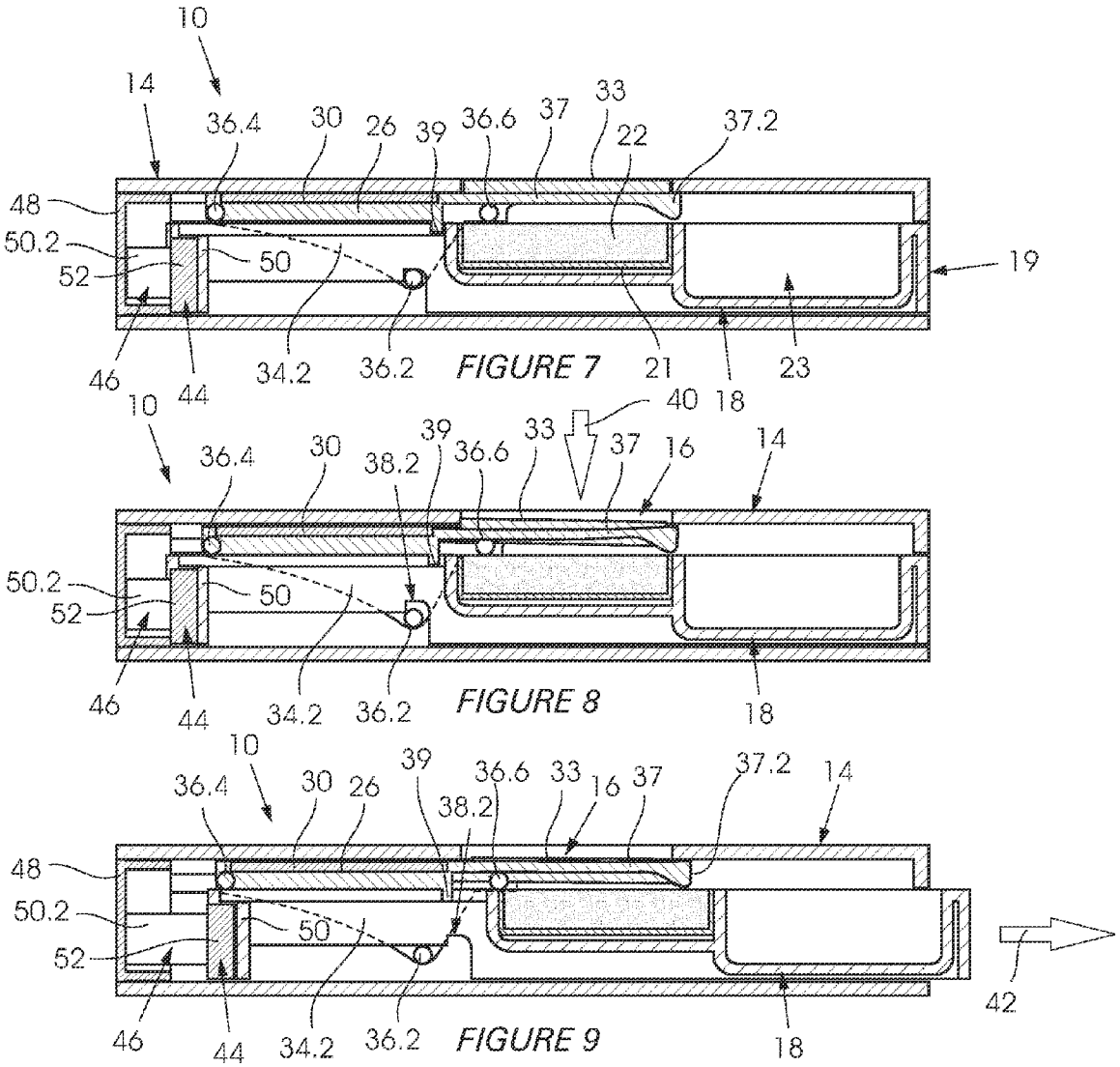
FIG. 7 shows a cross-sectional side view of the casing taken along line 7-7 shown in FIG. 2.
FIG. 8 shows a cross-sectional side view of the casing taken along line 8-8 shown in FIG. 3.
FIG. 9 shows a cross-sectional side view of the casing taken along line 9-9 shown in FIG. 4.
Figure 11:
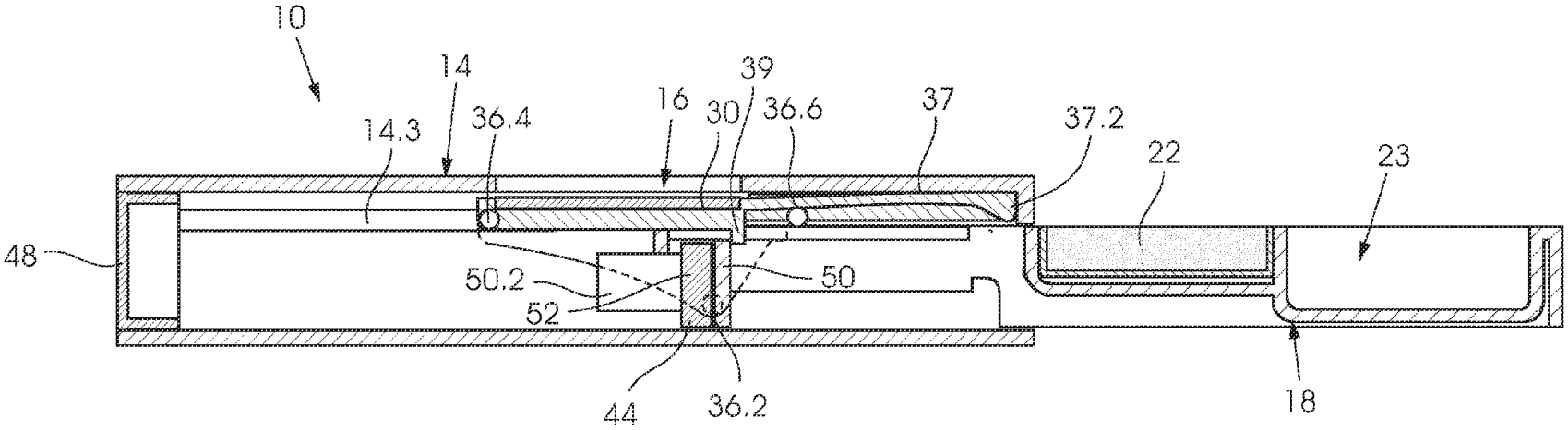
FIG. 11 shows a cross-sectional side view of the casing taken along line 11-11 shown in FIG. 6.

The tray 18 and the zone 28 are movable relative to the housing 14 between a retracted position, as shown in FIGS. 2 and 7, in which the cosmetic article 12 is displayed through the window 16 so that the cosmetic article 12 can be visually inspected through the window 16, and an extended position, as shown in FIGS. 6 and 11, in which the tray 18 protrudes from the housing 14 to facilitate access to the cosmetic article 12 and the zone 28 and mirror 30 can be viewed through the window 16.

The clipping arrangement 26 is arranged to secure the tray 18 in place within the housing 14 when the tray 18 and the zone 28 are in the retracted position. The clipping arrangement 26 comprises a transparent platform 32 having a rectangular raised surface 33 adjacent the zone 28, the raised surface also being transparent. The raised surface 33 is shaped and sized to be snugly accommodated within the window 16 of the housing 14 in the retracted position, as best shown in FIGS. 2 and 7, which further assists in securing the tray 18 in place within the housing 14.

Conveniently, the cosmetic product within the cosmetic product holder 22 can be visually inspected through the window 16 when the tray 18 and the zone 28 are in the retracted position. Conversely, in the extended position, the zone 28 and mirror 30 are displayed through the window 16, to facilitate the application of the cosmetic product.

In the illustrated embodiment, the clipping arrangement 26 comprises a pair of ears 34.1, 34.2 on opposite sides of the clipping arrangement 26, each ear 34.1, 34.2 being fitted with at least one inwardly protruding lug 36.1, 36.2 that engages a complementary recess or notch 38.1, 38.2 defined in the tray 18 so as to define the retracted position, as best shown in FIG. 7. Each ear 34.1, 34.2 further comprises a first pair of outwardly protruding guide pins 36.3 and 36.4 and a second pair of outwardly protruding guide pins 36.5 and 36.6 that are accommodated within corresponding internal guide channel portions 14.1, 14,2 and 14.3, 14.4, respectively, that are defined within the side walls 14.5, 14.6 of the housing 14.

The clipping arrangement 26 further comprises support arms 37 on either side of the platform 32, the support arms 37 and platform 32 being movable relative to each other. The support arms 37 terminate in flanges 37.1 that are arranged to slide along the edges 26.1, 26.2 of the clipping arrangement 26 on opposite ends of first and second recesses 20, 23.

Initially, the guide pins 36.3, 36.4 and 36.5, 36.6 rest within their corresponding guide channels 14.1, 14.2 and 14.3, 14.4, but in use they are arranged to slide along the guide channels, with the support flanges 37 accordingly being arranged to slide simultaneously along the edges 26.1, 26.2 of the clipping arrangement 26 proximate the first and second recesses 20, 23.

The sliding movement of the guide pins 36.3, 36.4, 36.5 and 36.6 within the guide channels 14.1, 14.2, 14.3, 14.4 and the support flanges 37 along the clipping arrangement 26 facilitate the sliding movement of the clipping arrangement 26 relative to the housing 14, as will be described in more detail further on in the specification.

The clipping arrangement 26 further comprises a downwardly extending pin 39 that can locate within the elongate slot 24.

Figure 3:
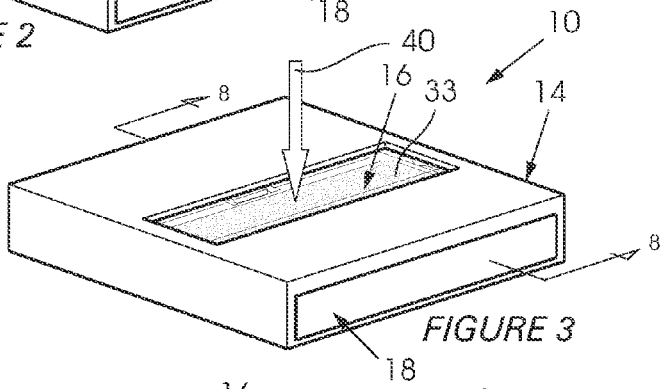
FIG. 3 shows a perspective view of the casing in an unclipped position, in which the clipping arrangement has been actuated so as to release the tray from the housing.
Figure 4:
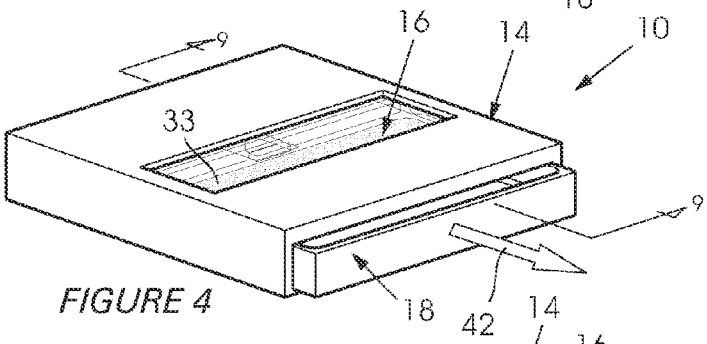
FIG. 4 shows a perspective view of the casing after it has been unclipped and the tray is moving out of the housing under the action of a pushing means located within the housing.

With reference to FIGS. 3 and 8, the clipping arrangement 26 can be actuated by depressing the raised surface 32 in the direction of arrow 40. This causes the protruding lugs 36.1, 36.2 to be released from the recesses 38.1, 38.2 so as to enable the tray 18 to be moved out of the housing 14, as indicated by arrow 42 in FIGS. 4 and 9. The direction of arrow 40 is thus perpendicular to the direction of arrow 42 i.e. perpendicular to the movement of the tray 18. In addition, arrow 42, corresponding to the movement of the tray 18, is in line (i.e. parallel) to the longitudinal axis of the housing 14.

In an embodiment, the casing 10 comprises pushing means 44 against which the tray 18 is in contact when the tray 18 and the zone 28 are in the retracted position. The pushing means 44 typically comprises a spring arrangement 46 positioned between an end wall 48 of the housing 14 and the tray 18. In the illustrated embodiment, the spring arrangement is securely fitted to the tray's end wall 50.

The spring arrangement 46 in FIG. 1 (and FIGS. 7 and 8) is shown in its compressed state, in which a pair of spring arms

50.1 and 50.2 lie proximate or adjacent a base 52 of the spring arrangement 46 to which the arms 50.1, 50.2 are fitted. Thus, in use, once the clipping arrangement 26 has been actuated so as to release the tray 18 from the housing 14, the spring arrangement 46 actively pushes the tray 18 out of the housing 14, again as indicated by arrow 42 in FIGS. 4 and 9. As indicated above, the direction of arrow 42 is parallel to the movement of the tray 18 and perpendicular to the direction of arrow 40. In this released configuration, the spring arms 50.1 and 50.2 of the spring arrangement 46 expand or move away from the base 52, thus explaining the relatively enlarged spring arms 50.1 and 50.2 in FIGS. 9 to 11.

Figure 5:
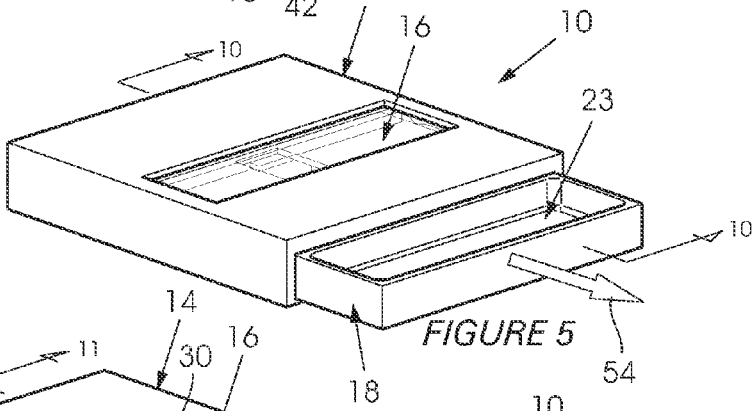
FIG. 5 shows a perspective view of the casing of FIG. 1 in an intermediate position in which the tray partially protrudes from the housing.
Figure 10:
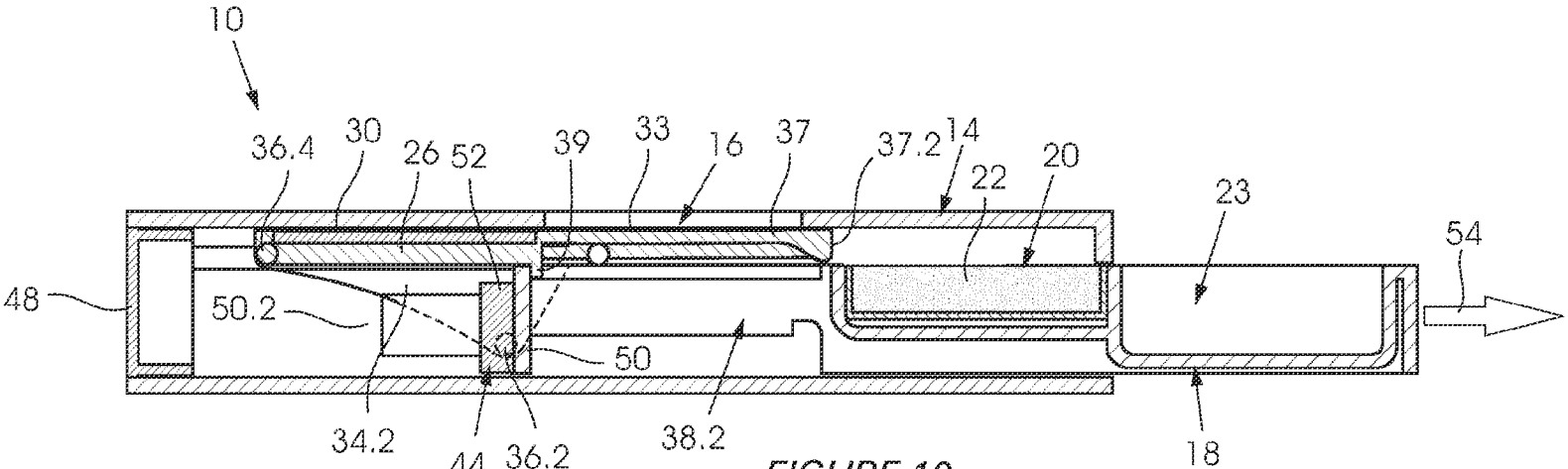
FIG. 10 shows a cross-sectional side view of the casing taken along line 10-10 shown in FIG. 5.

After the tray 18 has been released and the spring arrangement 46 has actively pushed the tray 18 out of the housing 14, the tray 18 may be manually moved by a user, as indicated by arrow 54 in FIGS. 5 and 10, so as to define an intermediate position. In this position, a portion of the tray 18, and in particular the second recess 23 that holds the cosmetic applicator or brush, protrudes from the housing 14, but with the zone 28 not being viewable through the window 16.

In the movement between the retracted position (FIGS. 2, 3, 7 and 8) and the intermediate position (FIGS. 5 and 10), the tray 18 moves relative to both the housing 14 and the clipping arrangement 26. In other words, during this movement, the clipping arrangement 26 remains stationary relative to the housing 14, as best shown in the cross-sectional views in FIGS. 7 to 10. During this movement, the pin 39 accommodates the full travel length of the slot 24, so that in the intermediate position, the pin 39 abuts against the end wall 25.

In the subsequent movement from the intermediate position (FIGS. 5 and 10) to the extended position shown in FIGS. 6 and 11, the end wall 25 will catch the pin 39 so that both the tray 18 and the clipping arrangement 26 move simultaneously relative to the housing 14. There is thus a delayed movement of the clipping arrangement 26 relative to the housing 14, which only takes place once the tray 18 has moved into the intermediate position.

The present invention thus provides a casing for a cosmetic article that has a window for not only allowing a visual inspection of the cosmetic product within the casing, in a first configuration, but which can also be used by a user to examine a mirror displayed through the window, in a second configuration.

The invention claimed is:

1. A casing for a cosmetic article, the casing comprising:

a housing defining a window;

a tray slidably accommodated within the housing and being movable relative to the window of the housing, the tray accommodating a cosmetic article; and a clipping arrangement slidably accommodated within the housing:

the clipping arrangement defining a zone within the housing, the defined zone being movable relative to the window of the housing in response to the movement of the tray, the clipping arrangement comprising a transparent platform adjacent the defined zone;

the tray and the clipping arrangement being movable relative to the housing between a fully retracted position, in which the cosmetic article is displayed through the transparent platform accommodated within the window so that the cosmetic article can be visually inspected through the transparent platform accommodated within the window, and an extended position, in which the tray protrudes from the housing to facilitate access to the cosmetic article and the defined zone can be viewed through the window that is not closed by the transparent platform; and wherein an intermediate position can be defined in which a portion of the tray protrudes from the housing but with the defined zone not being viewable through the window;

wherein the clipping arrangement secures the tray in place within the housing when the tray and the clipping arrangement are in the fully retracted position.

2. The casing of claim 1, wherein the cosmetic article comprises a cosmetic product holder to hold cosmetic product.

3. The casing of claim 1, wherein the clipping arrangement further comprises at least one protruding lug that engages a complementary recess defined in the tray to so as to define the fully retracted position.

4. The casing of claim 1, wherein in the movement between the fully retracted position and the intermediate position, the tray moves relative to both the housing and the clipping arrangement.

5. The casing of claim 1, wherein the clipping arrangement comprises at least one protruding pin, wherein an end wall of the tray can abut against the at least one protruding pin, so that in the movement between the intermediate position and the extended position, the end wall of the tray abuts against the pin of the clipping arrangement so that both the tray and the clipping arrangement move relative to the housing.

6. The casing of claim 2, wherein the cosmetic product can be visually inspected through the transparent platform accommodated within the window when the tray and the defined zone are in the fully retracted position.

7. The casing of claim 2, wherein the defined zone comprises or is fitted with a mirror so that in the extended position the mirror is displayed through the window that is not closed by the transparent platform, to facilitate the application of the cosmetic product.

8. The casing of claim 2, further comprising an associated cosmetic applicator to facilitate the application of the cosmetic product contained in the cosmetic product holder.

9. The casing of claim 3, wherein the clipping arrangement can be actuated to release the protruding lug from the recess so as to enable the tray to be moved out of the housing.

10. The casing of claim 9, wherein the casing comprises pushing means against which the tray is biased when the tray and the arrangement are in the fully retracted position, the pushing means being arranged to push the tray out of the housing after the clipping arrangement has been actuated to release the protruding lug from the recess.

11. The casing of claim 10, wherein the pushing means comprises a spring arrangement positioned between an end wall of the housing and the tray, wherein the spring arrangement is in a compressed state when the tray is in a fully retracted position.

12. The casing of claim 5, wherein the clipping arrangement comprises a guide pin, wherein the housing defines at least one internal guide channel to receive the guide pin to facilitate the movement of the clipping arrangement relative to the housing.

* * * * *